US006179243B1

(12) United States Patent
Granger

(10) Patent No.: US 6,179,243 B1
(45) Date of Patent: Jan. 30, 2001

(54) APPARATUS DISPENSING UNFOLDED WIPING MATERIAL

(76) Inventor: Maurice Granger, 17 Rue Marcel Pagnol, 42270, Saint Priest en Jarez (FR)

( * ) Notice: Under 35 U.S.C. 154(b), the term of this patent shall be extended for 0 days.

(21) Appl. No.: 09/424,183

(22) PCT Filed: Jun. 8, 1998

(86) PCT No.: PCT/FR98/01160

§ 371 Date: Nov. 19, 1999

§ 102(e) Date: Nov. 19, 1999

(87) PCT Pub. No.: WO98/56288

PCT Pub. Date: Dec. 17, 1998

(30) Foreign Application Priority Data

Jun. 9, 1997 (FR) ..... 97 07407

(51) Int. Cl.[7] ..... B65H 16/10

(52) U.S. Cl. ..... 242/564.5; 242/422.5; 242/598.1

(58) Field of Search ..... 242/564.1, 564.2, 242/564.4, 564.5, 418, 598.1, 598.5, 598.6, 422.5

(56) References Cited

U.S. PATENT DOCUMENTS

| | | | | |
|---|---|---|---|---|
| 4,691,503 | * | 9/1987 | Frerich | 242/564.4 X |
| 5,054,706 | | 10/1991 | Granger . | |
| 5,558,302 | * | 9/1996 | Jesperson | 242/560 |
| 5,772,291 | * | 6/1998 | Byrd et al. | 242/564.4 |

FOREIGN PATENT DOCUMENTS

| | | |
|---|---|---|
| 0192591 | 8/1986 | (EP) . |
| 2592022 | 6/1987 | (FR) . |
| 2621304 | 4/1989 | (FR) . |

* cited by examiner

*Primary Examiner*—Donald P. Walsh
*Assistant Examiner*—William A. Rivera
(74) *Attorney, Agent, or Firm*—Wall Marjama & Bilinski

(57) ABSTRACT

A dispensing apparatus including an adjusting device which ensures constant pressure of a reel supported on a spindle. The device is associated with reel-holder arms having resilient flexibility, rails forming a slide being arranged between side wings of a housing and the reel-holder arms to allow limited sliding movement of sliders floating on the rails with elastic capacity for controlled and adapted movement to enable paper material of the reel to be maintained constantly stretched on the spindle as material is depleted from the reel.

3 Claims, 5 Drawing Sheets

APPARATUS DISPENSING UNFOLDED WIPING MATERIAL

FIELD OF THE INVENTION

The invention relates to the technical field of machines for dispensing wipes made of paper, cellulose wadding, crepe paper or similar materials intended, in particular, for wiping users' hands, the dispensing of toilet paper and dispensing of paper towels.

BACKGROUND OF THE INVENTION

The Applicant has developed numerous patents for machines of the above-mentioned type and the reader is briefly reminded of the features of such machines which essentially comprise a housing (1) having a back surface **(1*a*) and two lateral wings (1*b*), the lower part of said housing extending downwards with a sloping profile, the entire assembly having a shape suitable for accommodating a cover (2). The lower part of the housing is capable of accommodating, in a known manner, an internally hollow drum (3) which houses a cutting device (4). The upper part of the housing accommodates two end shields (5*a*) (5*b*) capable of accommodating an articulated reel holder (6) having end fittings (6*d*) that support a reel of wipe material (B). Said reel of wipes is capable of resting against drum (3)** in a manner which allows the strip of material to be fed through and unwound to the rear between the drum and the back wall of the housing so that said strip of material emerges from the lower part of the machine. To ensure the reel of material grips the drum, it is necessary to exert a certain constant pressure while the reel of material is being unrolled, regardless of the forces applied.

The reel-holder end shield is capable of swivelling in order to allow constant adjustment against said drum. It is therefore necessary to seek to obtain and monitor correct unwinding of the paper strip depending on the diameter and weight of the roll of paper and depending on the tensile force exerted on the protruding end of the paper as it leaves the machine. One must also take into account the nature of the paper which can vary depending on the tightness of the turns and coils.

SUMMARY OF THE INVENTION

The aim sought after was therefore to devise a material dispensing machine that included a device for regulating the unwinding of the paper strip, thus making it possible to monitor, accurately and reliably, the dispensing of said paper strip.

According to a first aspect, the machine comprises a regulating device making it possible to ensure the reel exerts constant pressure on the drum, this device being associated with each of the arms of the reel holder in a flexible, elastic manner with rails forming a slide being located between the lateral wings of the housing and the reel-holder arms in order to allow sliding and limited displacement of the sliders loosely-mounted on said rails with the capacity for controlled, appropriate elastic movement and allowing, depending how much of the reel of material has been used up, said material to press against the drum with constant tension.

These aspects and others will become apparent from the following description.

BRIEF DESCRIPTION OF THE DRAWINGS

The object of the present invention is described, merely by way of example, in the accompanying drawings in which.

DETAIL DESCRIPTION

Figure 1:
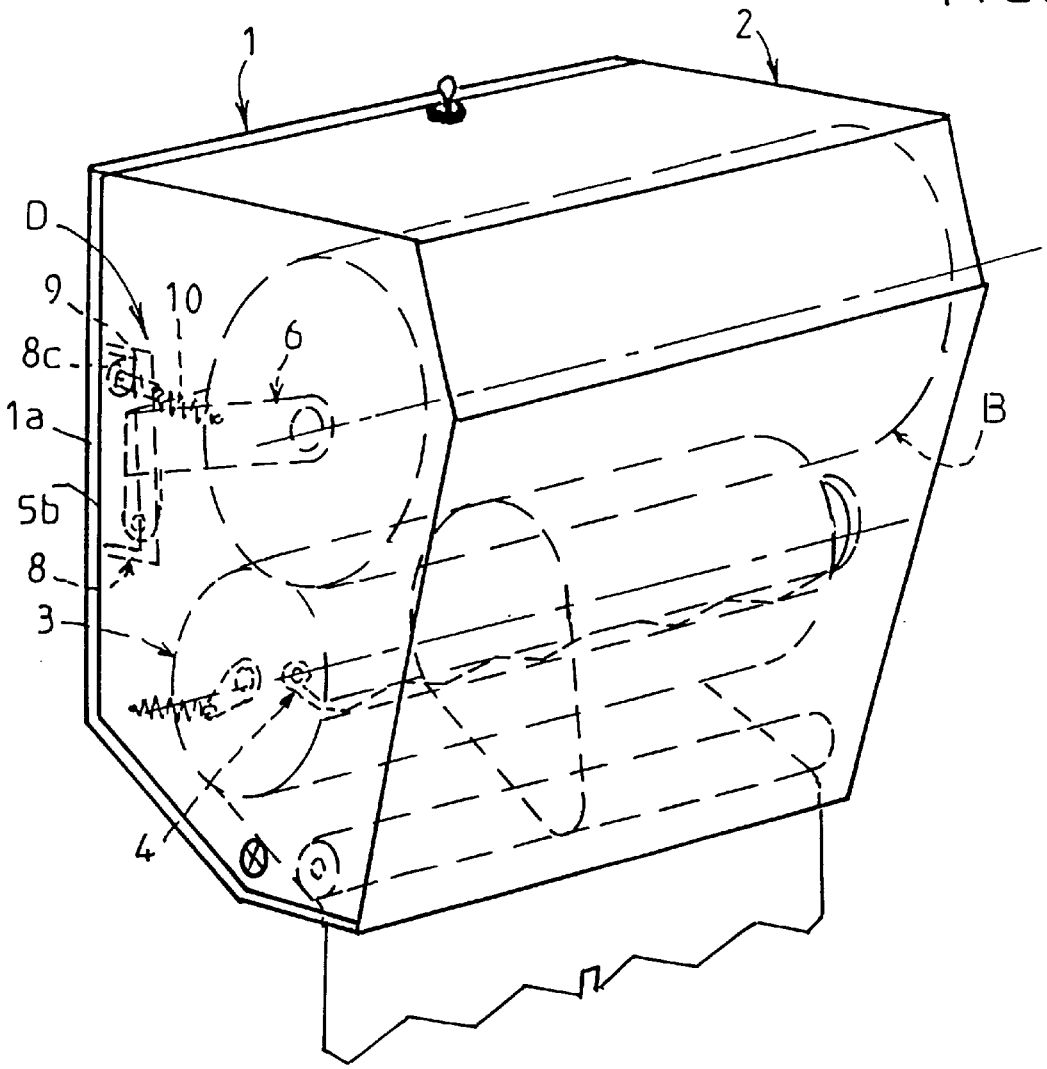
FIG. 1 is a perspective view of a paper wipe dispensing machine according to the invention.
Figure 2:
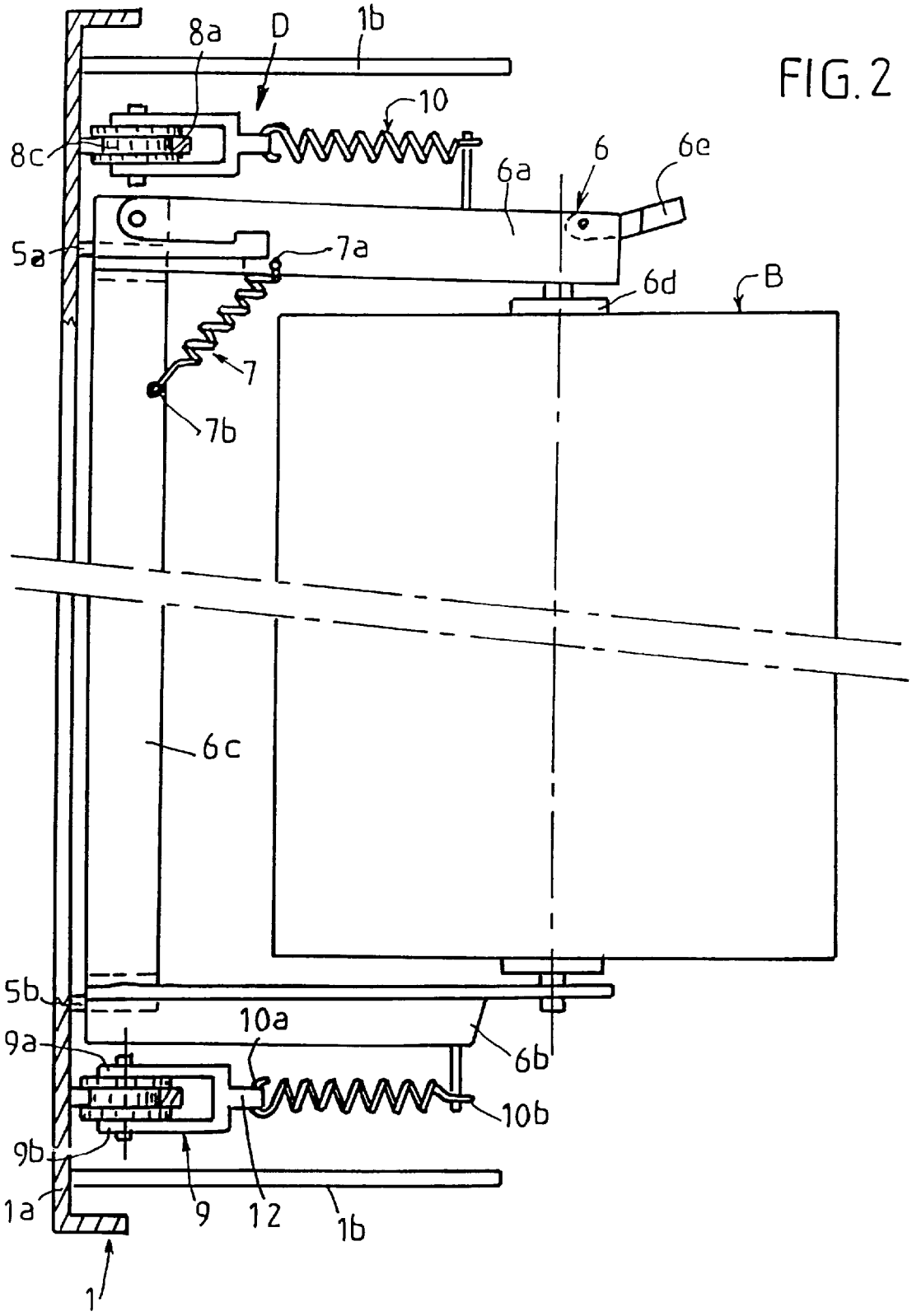
FIG. 2 is a top view of the machine with the cover removed.

In order that the present invention may be more readily understood, the following description is given, merely by way of example.

The machine of the above-mentioned type comprises a regulating device making it possible to ensure the reel of wipe material exerts constant pressure on the drum, regardless of the quality and thickness of the paper wipes.

The device is designed as follows:

The wipe reel (B) in the form of a roll is placed between the arms **(6*a*–6*b*) of the reel holder (6) which is articulated relative to the support plane formed by the back of the housing. The two arms are associated by a spacer bar (6*c*) capable of resting against the back of said housing. One of the arms (6*a*) has a fixed position whereas the other arm (6*b*) is moveable and articulated relative to above-mentioned spacer bar (6*c*) in order to allow the reel of material to be positioned, inserted and loaded. Said moving arm (6*b*) is articulated in opposition to an elastic return means (7) one end (7*a*) of which is attached to said arm and the other end (7*b*) of which is attached to the spacer bar. The upper part of each of the arms has an end fitting (6*d*) capable of fitting into the spindle of the reel of wipe material. Articulation of moving arm (6*b*) is obtained by means of a protruding profile (6*e*)** which can be manipulated by the operator.

According to the invention, each arm **(6*a*–6*b*) of the reel holder is associated with a sliding moveable device (D) capable of tracking the swivelling of the reel holder as the diameter of the loaded reel reduces. To achieve this, between the lateral wings (1*b*) on the housing and the arms (6*a*–6*b*) of the reel holder, there are, in the gaps in question, rails (8) having a vertical straight run (8*a*) and perpendicular ends (8*b*) fixed to the back of the housing, thus producing an internal opening (8*c*). These long rails allow the movement and sliding of a slider (9) loosely mounted and articulated in opposition to a tension spring (10). Each slider (9) itself comprises two parallel side pieces (9*a*–9*b*) spaced apart from each other and connected at their end by means of a roller (11) or similar which is capable of pressing against the lower edge (8*d*) of the vertical run (8*a*) of the guide rail. The upper parts of the two side pieces (9*a*–9*b*) of said slider are associated by means of a small plate (12) having characteristics and dimensions similar to the rollers (11) and making it possible to attach one end (10*a*) of return spring (10). The other end (10*b*) of said spring (10) is attached to arm (6*a*–6*b*) of the reel holder. Each slider (9) is loosely mounted in opposition to an elastic means whilst being guided around said corresponding rail (8)** and being capable of moving along the latter as the reel holder swivels. Said slider follows the arms of the reel holder along the guide rails, thus ensuring that the reel of material is constantly tensioned over the drum.

Figure 3:
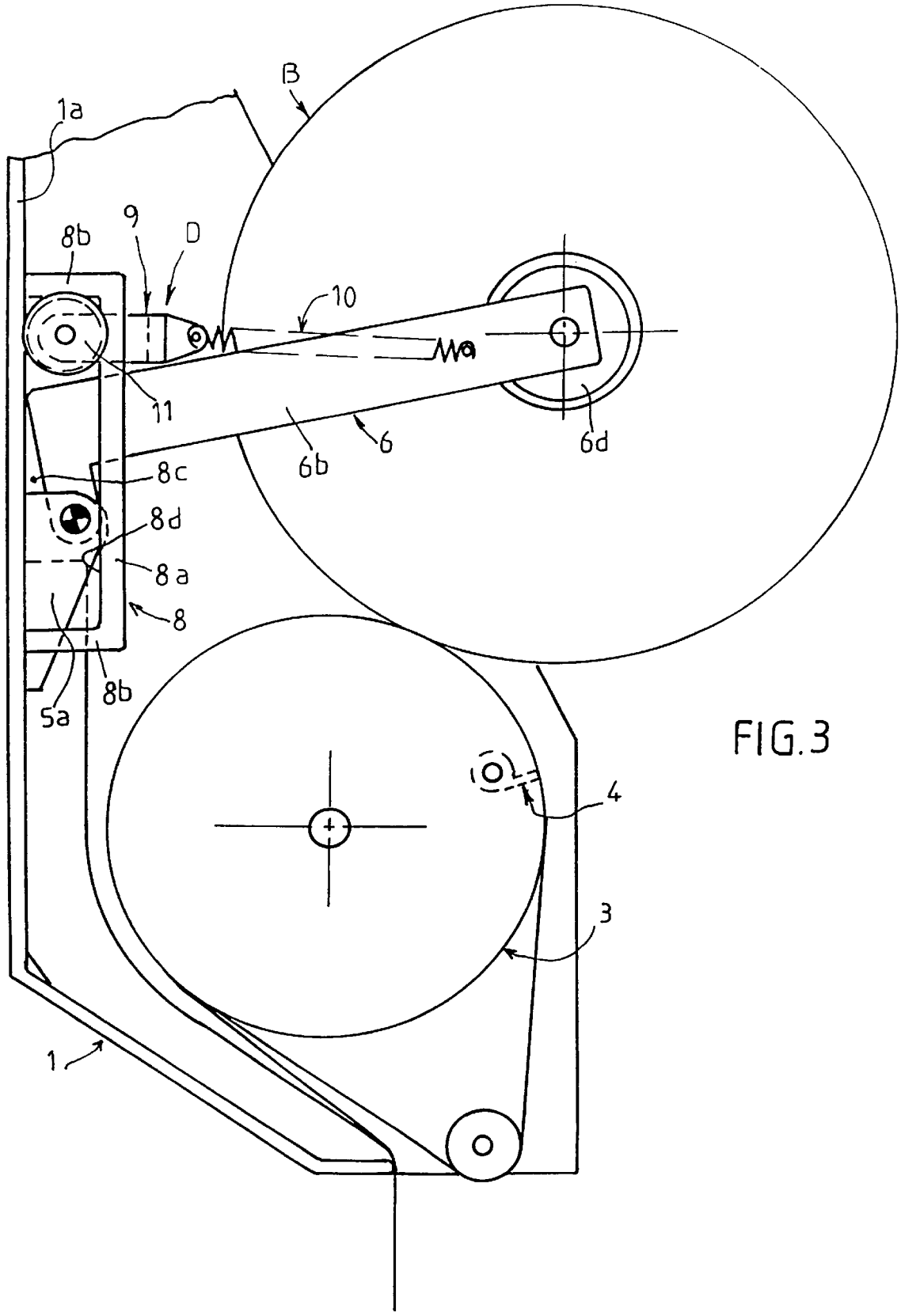
FIG. 3 is a profile view showing the unwinding regulating device in its upper position when use of the reel has just started.
Figure 4:
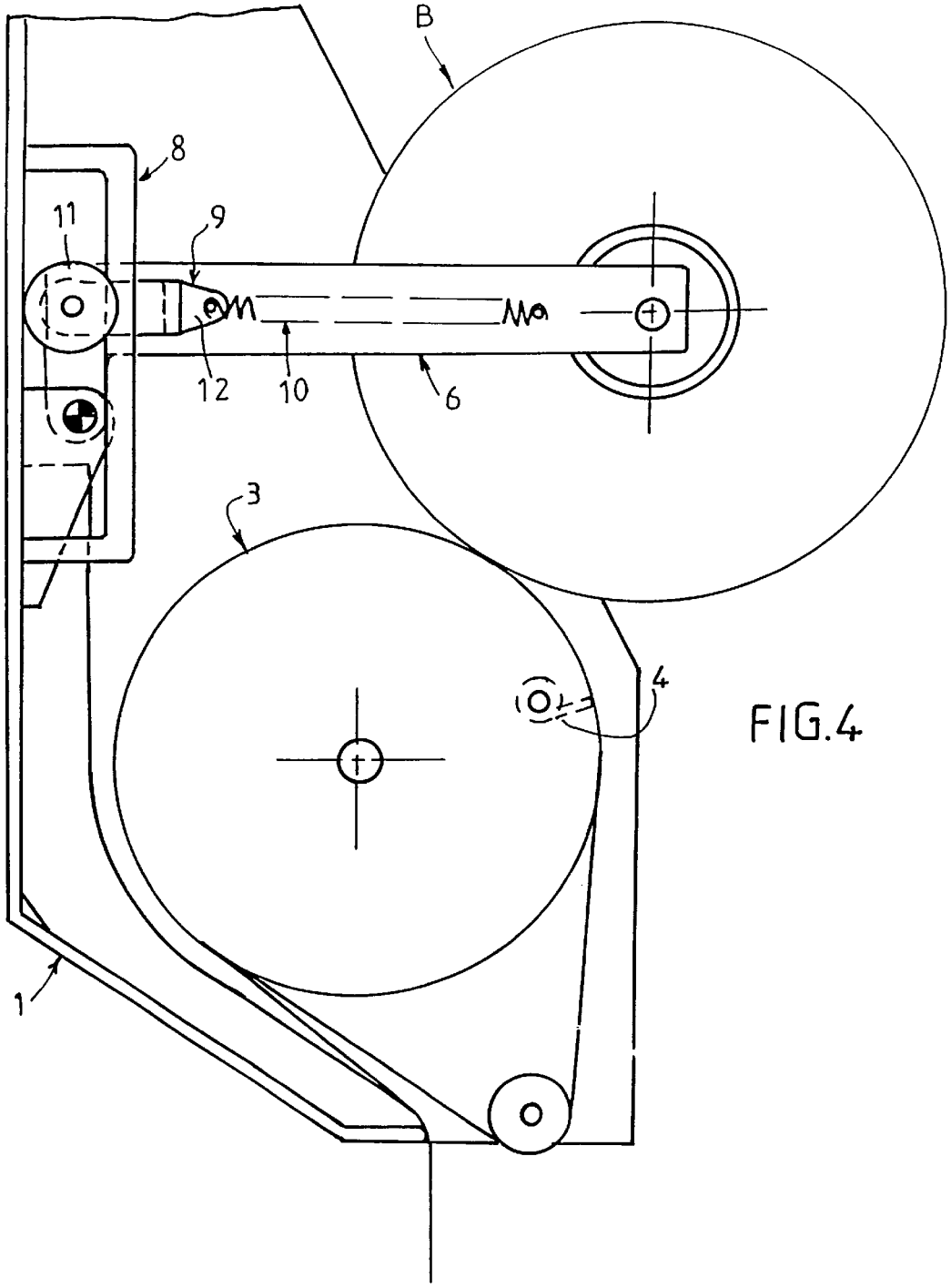
FIG. 4 is a view according to FIG. 3 in an intermediate phase.
Figure 5:
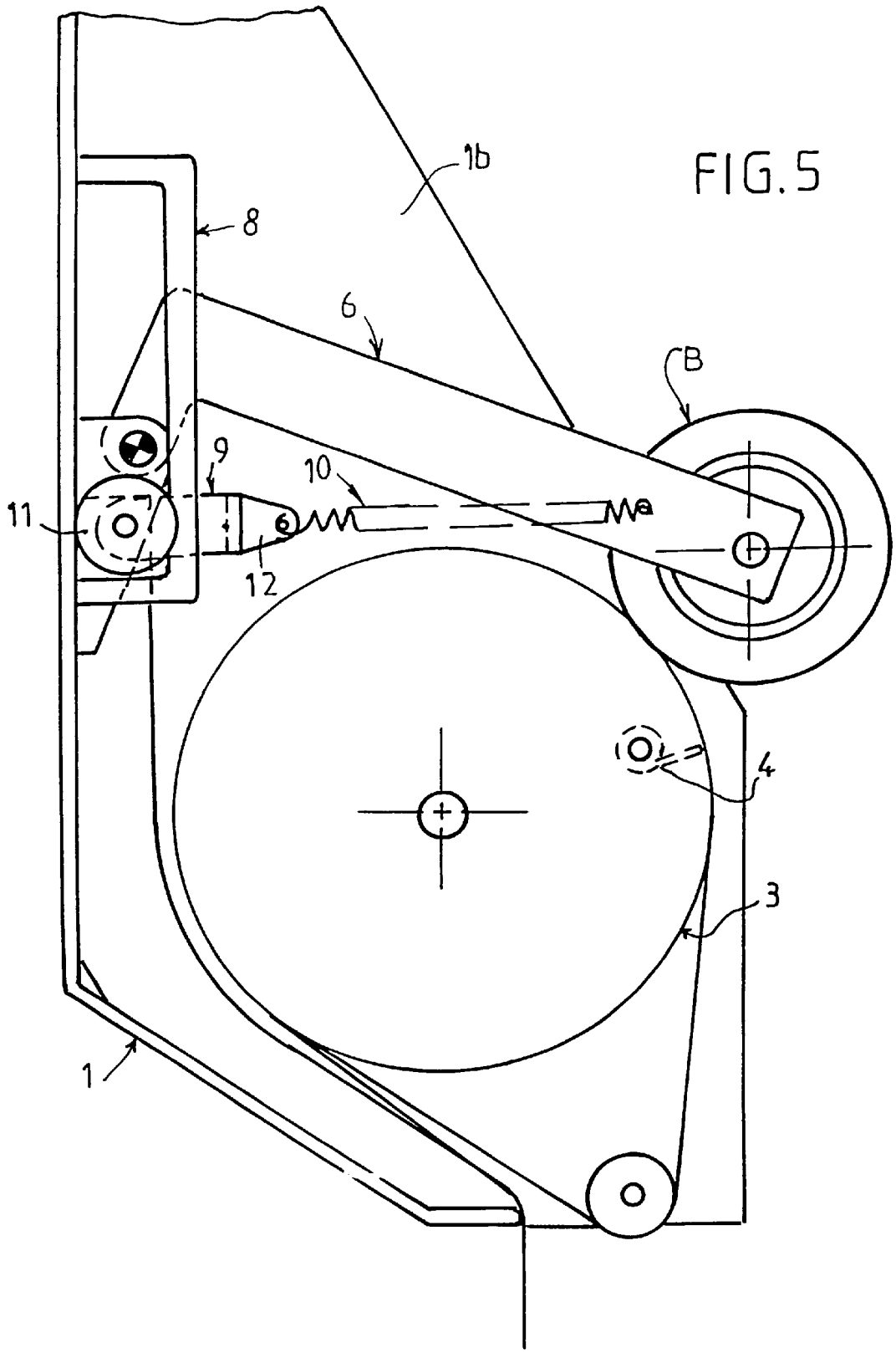
FIG. 5 is a view according to FIGS. 3 and 4 with the wipe reel almost used up.

As shown in FIGS. 3, 4 and 5, because the return spring (10) associated with each slider is stretched, the exerted tension is constant, controlled and appropriate, regardless of the diameter of the roll of material.

In FIG. 3, the roll or reel of material is full and heavy and springs (10) are on one side of the swivel axis of the reel holder, thus lightening the reel holder and therefore the roll.

In FIG. 4, the roll has begun to be used up and is smaller. The axes of the rollers of the sliders and the swivel axes of the reel holder are aligned in the maximum-extension position of springs (10), corresponding to the reel holder's dead centre; they therefore have no effect on the reel holder and the weight of the roll presses against the drum.

In FIG. 5, when the roll has been unwound further, the reel holder moves to the other side of the swivel axis and the springs operate and ensure that the material is pressed against the drum.

The rails therefore fulfil a slide function allowing limited movement of the sliders. Their loose, elastic mounting makes it possible to match all the tensile forces exerted on the strip of material by the user in order to provide the desired compensation effect.

The advantages of the invention are clearly apparent. The simplicity of the tension regulating device is emphasised.

What is claimed is:

1. Dispensing machine for wipe material being dispensed in unfolded form of the type comprising a housing having a back surface **(1*a*)** and two lateral wings, the lower part of said housing extending downwards with a slanting profile, the entire assembly having a shape suitable for accommodating a cover, the lower part of the housing accommodates an internally hollow drum which houses a cutting device, the upper part of the housing accommodates two end shields accommodating an articulated reel holder having support end fittings and at least two arms for unwinding a reel of wipe material, said reel of wipe material resting against drum in a manner which allows the strip of material to be fed through and unwound to the rear between the drum and the back wall of the housing so that said strip of material emerges from the lower part of the machine, a regulating device (D) to ensure the reel exerts constant pressure on the drum, the regulating device being associated with each of the arms of the reel holder in a flexible, elastic manner, with rails forming a slide being located between the lateral wings of the housing and the reel-holder arms, sliders loosely mounted on said rails, said rails allow sliding and limited displacement of said sliders for controlled, elastic movement of each of the arms and allowing, depending how much of the reel of material has been used up, said material to press against the drum with constant tension.

2. Machine as claimed in claim 1, wherein rails have a vertical run and perpendicular ends fixed to the back of the housing with an internal opening and in that each slider is loosely mounted on the rails, tension springs associated with each of the arms of the reel holder, said tension springs connecting each slider to a respective arm of the reel holder.

3. Machine as claimed in claim 2, wherein each slider itself comprises two parallel side pieces spaced apart from each other and connected at their end by means of a roller which is pressing against the lower edge of the vertical run of the guide rail, and in that the upper parts of the two side pieces of said slider are associated by means of a small plate having characteristics and dimensions similar to the roller and making it possible to attach one end of the tension spring to said small plate, and in that the other end of said spring is attached to the arm of the reel holder, and in that each slider is loosely mounted in opposition to an elastic means whilst being guided around said corresponding rail and being moving along the corresponding rail as the reel holder swivels.

* * * * *